US007607330B2

(12) United States Patent
Casal et al.

(10) Patent No.: US 7,607,330 B2
(45) Date of Patent: Oct. 27, 2009

(54) MACHINE FOR DRAWING METAL SHEETS

(75) Inventors: Elixabete Casal, San Sebastian (ES); Unai Argarate, Bilbao (ES); Oscar Gonzalez, San Sebastian (ES); Alvaro Martinez, Vitoria (ES)

(73) Assignee: Fagor, S. Coop, Mondragon (Guipuzcoa) (ES)

( * ) Notice: Subject to any disclaimer, the term of this patent is extended or adjusted under 35 U.S.C. 154(b) by 63 days.

(21) Appl. No.: 11/974,584

(22) Filed: Oct. 15, 2007

(65) Prior Publication Data

US 2008/0034827 A1 Feb. 14, 2008

(30) Foreign Application Priority Data

Aug. 11, 2006 (ES) ..... 200602844

(51) Int. Cl.
*B21D 11/02* (2006.01)
*B21D 11/00* (2006.01)

(52) U.S. Cl. ..... 72/302; 72/305

(58) Field of Classification Search ..... 72/300–302, 72/305, 306, 308, 309, 311, 316, 377, 392, 72/705; 29/281.1

See application file for complete search history.

(56) References Cited

U.S. PATENT DOCUMENTS 527,486 A * 10/1894 Foster ..... 72/305
2,738,824 A * 3/1956 Holopchak ..... 72/375
6,205,830 B1 3/2001 Voges

* cited by examiner

*Primary Examiner*—Dana Ross
*Assistant Examiner*—Teresa M Bonk
(74) *Attorney, Agent, or Firm*—Tim L. Kitchen; Peter B. Scull; Berenbaum Weinshienk PC

(57) ABSTRACT

Machine for drawing metal sheets, which comprises a static support (3) and a moving support (4) that hold a metal sheet (2) during a process of drawing said metal sheet (2), and driving means (5) that cause a longitudinal movement of said moving support (4) in relation to said static support (3) during said process, a section (S) of said metal sheet (2) comprised between said supports (3, 4) being drew and tensioned. Said machine (1) also comprises a third support (6) that remains static during the drawing process and which is disposed between the static support (3) and the moving support (4), and the driving means (5) cooperate with said third support (6) in order to move said moving support (4) longitudinally during said drawing process.

9 Claims, 2 Drawing Sheets

MACHINE FOR DRAWING METAL SHEETS

TECHNICAL FIELD

The present invention relates to machines adapted for the drawing of metal sheets.

PRIOR ART

Generally metal sheets are rolled in a reel and when unrolled, they may present, for example, leveling problems. One way of eliminating these problems is to feed the metal sheets between rollers as they are unrolled from said reel, although the total elimination of said problems by means of a single operation is both difficult and expensive, with a second operation being necessary in many cases.

There are known machines that use the drawing of the metal sheet to eliminate the aforementioned leveling problems. Some of these machines comprise a shear or a cutting tool that cuts a section of said metal sheet, and by then holding both ends of said section and effecting the relative distancing of both ends, said section of metal sheet is then drawn.

U.S. Pat. No. 6,205,830 B1, for example, discloses a machine with a drawing module. In order to hold the metal sheet said module comprises a static support fixed to the structure of said machine and a moving support, so that while the static support remains immobile and the moving support moves longitudinally driven by driving means, a section of metal sheet comprised between both supports is drawn. During said drawing the stresses generated are supported by the structure of the machine, a very solid structure with specific characteristics therefore being necessary in order to prevent said stresses from affecting said section of metal sheet and generating a non-homogenous drawing, for example.

DISCLOSURE OF THE INVENTION

It is an object of the invention to provide a machine for drawing metal sheets as homogenously as possible.

The machine of the invention comprises a static support and a moving support that hold a metal sheet during a process of drawing said metal sheet, and driving means that cause a longitudinal movement of said moving support in relation to said static support during said process, drawing the section of said metal sheet comprised between said supports.

The machine of the invention also comprises a third support that comprises a window through which the metal sheet passes and which remains static during the drawing process. Said third support is disposed between the static support and the moving support, the driving means being disposed between said third support and said moving support.

In this way, the driving means cooperate with the third support in order to move the moving support longitudinally during the drawing process, said third support thereby absorbing at least part of the stresses generated during said process, thereby reducing the risk of obtaining a non-homogenous drawing of the section of the metal sheet comprised between the static support and the moving support.

These and other advantages and characteristics of the invention will be made evident in the light of the drawings and the detailed description thereof.

DETAILED DISCLOSURE OF THE INVENTION

Figure 1:
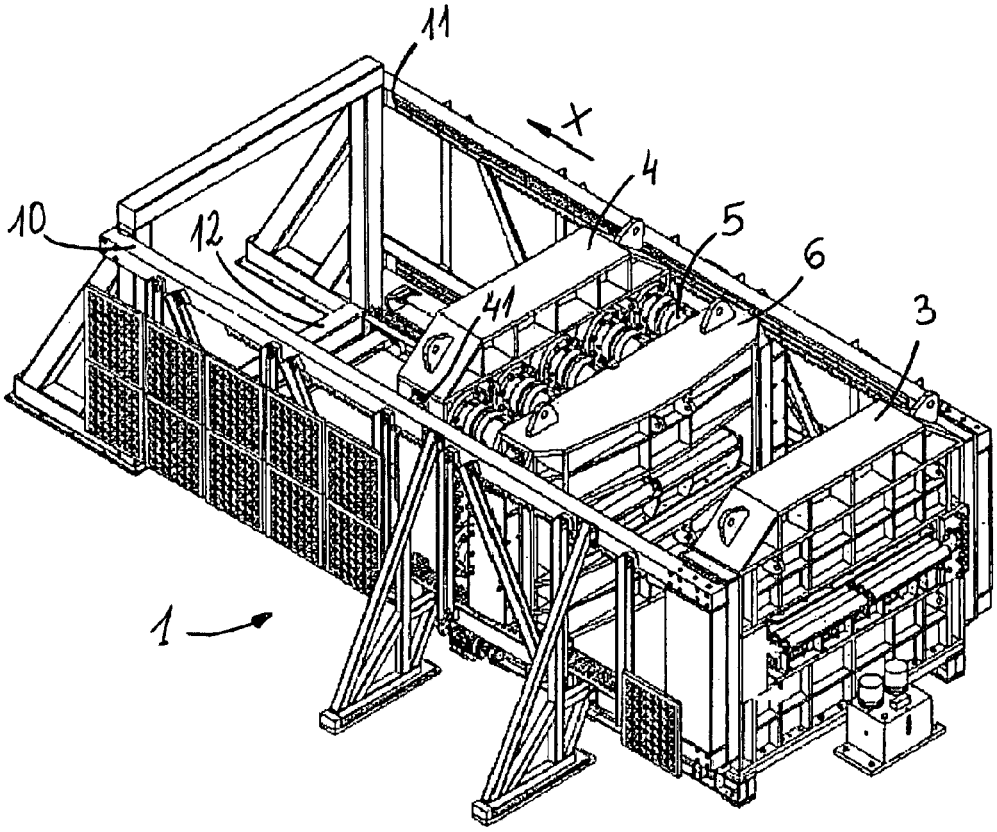
FIG. 1 is a perspective view of an embodiment of the machine of the invention.
Figure 2:
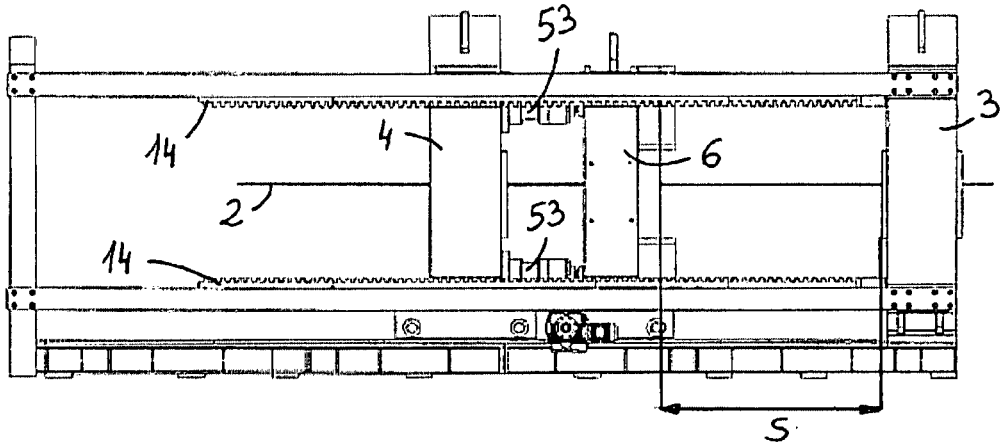
FIG. 2 is a side view of the machine of FIG. 1.
Figure 3:
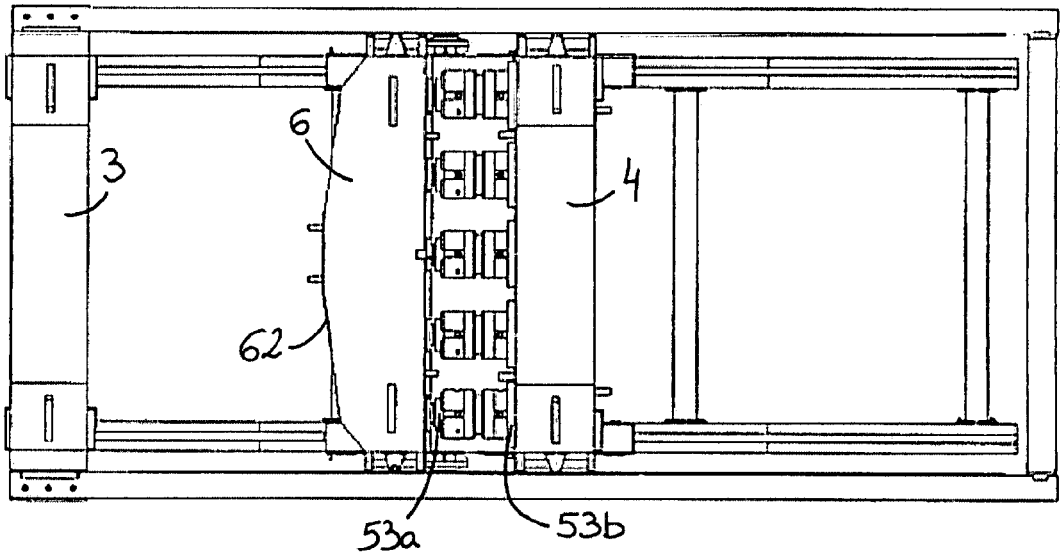
FIG. 3 is a ground view of the machine of FIG. 1.

FIGS. 1 to 3 show an embodiment of the machine 1 of the invention, used to draw metal sheets 2. The metal sheets 2 are, generally, rolled up in a reel (not shown in the figures) and reach said machine 1 as said reel is unrolled, being fed into said machine 1 longitudinally.

When the metal sheet 2 has entered the machine 1, a static support 3 and a moving support 4 hold said metal sheet 2 by means of respective holding means (not shown in the figures), with the purpose being that a section S of said metal sheet 2 comprised between said supports 3 and 4 is drawn during a drawing process. Said holding means may comprise, for example, a plurality of holding cylinders.

The machine 1 comprises a structure 10 with a base 12 upon which are disposed the supports 3 and 4. The static support 3 is fixed to said structure 10, remaining static at all times, whereas the moving support 4 moves longitudinally in a direction of movement X, distancing itself from said static support 3 during the drawing process by means of driving means 5 disposed in said machine 1. During said process, the metal sheet 2 is held by the respective holding means of said supports 3 and 4, as a result of which when said moving support 4 moves, the section S of said metal sheet 2 comprised between both supports 3 and 4 is drawn. The structure 10 of the machine 1 also comprises guiding means for guiding the movement of the moving support 4, said guiding means comprising at least one guide 11 that extends longitudinally along the entire length of the machine 1, although in the preferred embodiment it comprises two parallel guides 11 on each of its sides. Said moving support 4 comprises on its sides means 41 that cooperate with said guides 11 when it moves longitudinally.

During the drawing process, due to the force exerted by the driving means 5 and to the strength of the metal sheet 2 to be drawn, stresses are generated with the risk that said metal sheet 2 is drawn in a non-homogenous manner.

Figure 4:
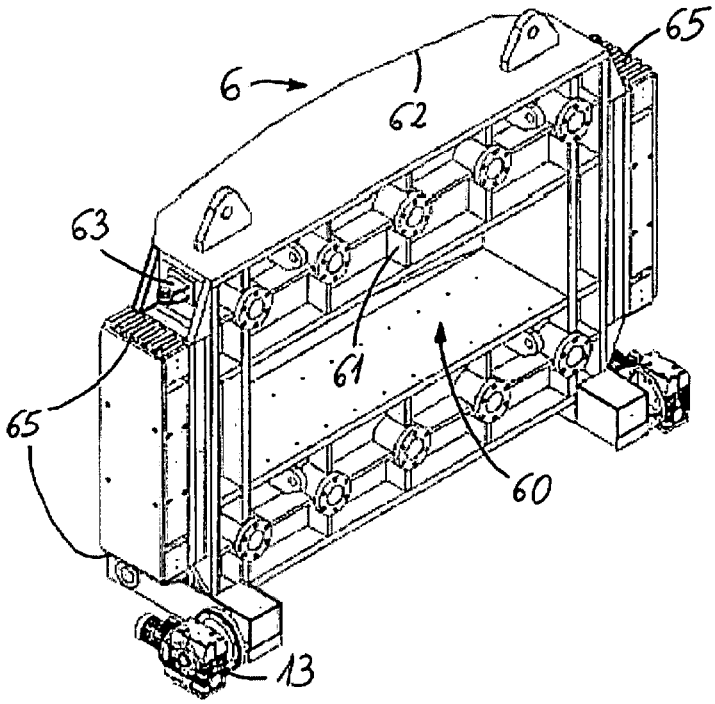
FIG. 4 is a perspective view of the third support of the machine of FIG. 1.

In order to absorb at least part of said stresses, the machine 1 of the invention also comprises a third support 6, shown in FIG. 4, which is disposed on the base 12 of the structure 10 and between the static support 3 and the moving support 4, and which remains static while said moving support 4 moves during the drawing process. Said third support 6 is joined to said structure 10 by means of joining means. Said structure 10 comprises at least one toothed surface 14, and the joining means comprise at least one toothed element 65 that cooperates with each toothed surface 14 to keep said third support 6 joined to said structure 10. In the preferred embodiment said support 6 comprises linking means on each of its sides, with each one of said linking means comprising two toothed elements 65. Acting means (not shown in the figures) have the function of freeing said toothed elements 65 from said toothed surfaces 14 when this is necessary, or of ensuring said toothed elements 65 continue to cooperate with said toothed surfaces.

The driving means 5 of the machine 1 are disposed between the third support 6 and the moving support 4 so that during the drawing process, said driving means 5 cooperate with said third support 6 to move said moving support 4 longitudinally. Said third support 6 comprises a window 60 through which the metal sheet 2 passes, not holding said metal sheet 2. In this way, during said drawing process, said metal sheet 2 does not suffer any pressure or alteration from said third support 6. For the passage of said metal sheet 2, said window 60 extends axially and comprises a width substantially equal to or greater than the width of said metal sheet 2.

The driving means 5 comprise at least one set of cylinders 53 disposed longitudinally between the moving support 4 and the third support 6, aligned along the width of said supports 4 and 6. In the preferred embodiment, said driving means 5 comprise two sets of cylinders 53 disposed parallel to each other, the metal sheet 2 being disposed between both sets of cylinders 53, each of the sets of cylinders 53 extending along the entire width of said metal sheet 2, so that when it causes the movement of said moving support 4 said movement is substantially homogenous. In said preferred embodiment a base 53*a* of each cylinder 53 is fixed to said moving support 4, a piston 53*b* of each of said cylinders 53 extending towards said third support 6 when said cylinders 53 are driven, thereby causing the longitudinal movement of said moving support 4 as said third support 6 remains static. Said bases 53*a* may also be linked to said third support 6, said pistons 53*b* pushing said moving support 4 when said cylinders 53 are driven.

The third support 6 also comprises a plurality of ribs 61 that extend radially out from each of the cylinders 53, so that when said cylinders 53 cause the longitudinal movement of the moving support during the drawing process, said ribs 61 absorbing at least part of the stresses generated during said process, these stresses not affecting the section S of the drawn metal sheet 2. In the preferred embodiment, said ribs 61 extend in a substantially horizontal and a substantially vertical manner in the shape of a cross.

When a metal sheet 2 is drawn in a non-homogenous way, said metal sheet 2 is drawn more in the centre, with its ends comprising the least amount of drawing. To enable said drawing to be as homogenous as possible, the third support 6 also comprises a substantially curved profile 62 on its face facing the static support 3 with the purpose of counteracting said possible non-homogenous drawing, thereby reducing the risk of non-homogenous drawing being generated.

The length of the section S of metal sheet 2 to be drawn may be modified, the moving support 4 and the third support 6 being moved longitudinally before the drawing process (and without said moving support 4 holding said metal sheet 2). As a result, the machine 1 comprises acting means 13 fixed to said third support 6, which may comprise, for example, a motor that causes a simultaneous longitudinal movement of said third support 6 and said moving support 4. Said third support 6 comprises on its sides means 63 that cooperate with the guides 11 of the guiding means of the structure 10, as they move longitudinally.

The invention claimed is:

1. Machine for drawing metal sheets, which comprises a static support, a moving support, the static support and the moving support holding a metal sheet during a process of drawing said metal sheet, driving means that cause a longitudinal movement of said moving support in relation to said static support during said process, a section of said metal sheet being disposed between said supports being drawn and tensioned, and a third support that remains static during the drawing process and which is disposed between the static support and the moving support, the driving means being disposed between said third support and said moving support, and said third support including a window through which the metal sheet passes, so that said driving means cooperate with said third support in order to move said moving support longitudinally during said drawing process.

2. Machine according to claim 1, wherein the driving means comprise at least one set of cylinders disposed longitudinally between the moving support and the third support, aligned along the entire width of said supports.

3. Machine according to claim 2, wherein the driving means comprise two sets of cylinders disposed parallel to each other.

4. Machine according to claim 2, wherein a base of the cylinders is fixed to the moving support, a piston of said cylinders extending towards the third support when said cylinders are driven.

5. Machine according to claim 2, wherein the third support comprises a plurality of ribs that extend radially out from each of the cylinders.

6. Machine according to claim 5, wherein the ribs of the third support extend in a substantially horizontal and a substantially vertical manner.

7. Machine according to claim 1, wherein the third support comprises a substantially curved profile on its face facing the static support.

8. Machine according to claim 1, wherein it comprises acting means for moving the third support and the moving support longitudinally at the same time.

9. Machine according to claim 8, wherein the acting means are linked to the third support.

* * * * *